US009165414B2

(12) United States Patent
Karnik et al.

(10) Patent No.: US 9,165,414 B2
(45) Date of Patent: Oct. 20, 2015

(54) METHOD AND SYSTEM FOR PREDICTING PERFORMANCE OF AN AIRCRAFT

(75) Inventors: Siddharth Karnik, Maharashtra (IN); Frank Rajkumar Elias, Karnataka (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 1335 days.

(21) Appl. No.: 12/706,524

(22) Filed: Feb. 16, 2010

(65) Prior Publication Data

US 2011/0202208 A1 Aug. 18, 2011

(51) Int. Cl.
*G07C 5/08* (2006.01)

(52) U.S. Cl.
CPC ..... *G07C 5/0841* (2013.01); *G07C 5/0816* (2013.01)

(58) Field of Classification Search
CPC ..... G07C 5/0841; G07C 5/0816
USPC ..... 701/3, 14–18, 29.1, 29.7–29.9; 340/945, 963, 971
See application file for complete search history.

(56) References Cited

U.S. PATENT DOCUMENTS

| | | | | |
|---|---|---|---|---|
| 6,243,628 | B1 | 6/2001 | Bliley et al. | |
| 6,363,332 | B1 | 3/2002 | Rangarajan et al. | |
| 7,236,914 | B1 | 6/2007 | Zyskowski | |
| 7,273,278 | B2 | 9/2007 | Fronzek | |
| 2003/0187554 | A1 | 10/2003 | Henry et al. | |
| 2004/0176887 | A1 * | 9/2004 | Kent et al. | 701/30 |

FOREIGN PATENT DOCUMENTS

| | | | |
|---|---|---|---|
| EP | 1043697 | A2 | 11/2000 |
| EP | 1043697 | A3 | 5/2004 |
| EP | 1455313 | A1 | 9/2004 |

OTHER PUBLICATIONS

EP Search Report, EP 10191789.6-2211 dated Feb. 28, 2011.
EP Examination Report, EP 10191789.6-1608 dated Feb. 23, 2015.

* cited by examiner

*Primary Examiner* — Kaitlin Joerger
(74) *Attorney, Agent, or Firm* — Ingressia Fisher & Lorenz, P.C.

(57) ABSTRACT

Methods and systems for operating an avionics system on-board an aircraft are provided. A plurality of signals representative of a current state of the aircraft are received. A future state of the aircraft is calculated based on the plurality of signals representative of the current state of the aircraft. An indication of the future state of the aircraft is generated with the avionics system on-board the aircraft.

17 Claims, 3 Drawing Sheets

METHOD AND SYSTEM FOR PREDICTING PERFORMANCE OF AN AIRCRAFT

TECHNICAL FIELD

The present invention relates to avionics systems, and more particularly relates to methods and systems for predicting performance, or a future state, of an aircraft and providing the prediction to a user, such as a pilot or engineer.

BACKGROUND

Despite of the ever increasing sophistication of avionics systems, during the various stages of aircraft operation, personnel (e.g., pilots or engineers) are required to monitor seemingly countless items, including the configuration of the aircraft, appropriately respond to unpredicted changes in performance, and properly control the various axes of the aircraft. With respect to such items, during flight aircraft crew members are required to make crucial decisions which may affect the state of the aircraft.

Conventional, present warning systems are essentially "feedback" systems that inform the crew of the effects of a particular decision, or course of action taken based on a decision, after the effect has taken place. Additionally, conventional warning systems are non-desirable because they typically fail to account for the aging of various components on the aircraft. The aging, or wear, on a component is typically determined during maintenance using Mean Time Between Failure (MTBF) measurements provided by the manufacturer of the component. There are limited means to determine the aging or degradation while the component is in operation, as such testing generally needs to be performed in a non-obtrusive manner.

Accordingly, it is desirable to provide a method and system for predicting the performance of an aircraft and providing a user with an indication of the predicted performance. Furthermore, other desirable features and characteristics of the present invention will become apparent from the subsequent detailed description and the appended claims, taken in conjunction with the accompanying drawings and the foregoing technical field and background.

BRIEF SUMMARY

In one embodiment, a method for operating an avionics system on-board an aircraft is provided. A plurality of signals representative of a current state of the aircraft are received. A future state of the aircraft is calculated based on the plurality of signals representative of the current state of the aircraft. An indication of the future state of the aircraft is generated with the avionics system on-board the aircraft.

In another embodiment, a method for operating an avionics system on-board an aircraft is provided. A plurality of signals representative of a current state of the aircraft are received. A future state of the aircraft is calculated based on the plurality of signals representative of the current state of the aircraft and at least one air performance model associated with the aircraft. An indication of the future state of the aircraft is generated with the avionics system on-board the aircraft.

In a further embodiment, an avionics system is provided. The avionics system includes a plurality of avionics devices, each being configured to generate a signal representative of a current state of an aircraft, an alert generator configured to provide an alert to a user on-board the aircraft, and a processing system in operable communication with the plurality of avionics devices and the alert generator. The processing system is configured to calculate a future state of the aircraft based on the signals representative of the current state of the aircraft and cause the alert generator to generate an alert to the user on-board the aircraft based on the calculated future state of the aircraft.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, and brief summary or the following detailed description. It should also be noted that FIGS. 1-3 are merely illustrative and may not be drawn to scale.

Systems and methods in accordance with various aspects of the present invention provide improved signal processing schemes. In this regard, the present invention may be described herein in terms of functional block components and various processing steps. It should be appreciated that such functional blocks may be realized by any number of hardware, firmware, and/or software components configured to perform the specified functions.

For example, the present invention may employ various integrated circuit components, such as memory elements, digital signal processing elements, look-up tables, databases, and the like, which may carry out a variety of functions, some using continuous, real-time computing, under the control of one or more microprocessors or other control devices. Such general techniques and components that are known to those skilled in the art are not described in detail herein.

Figure 1:
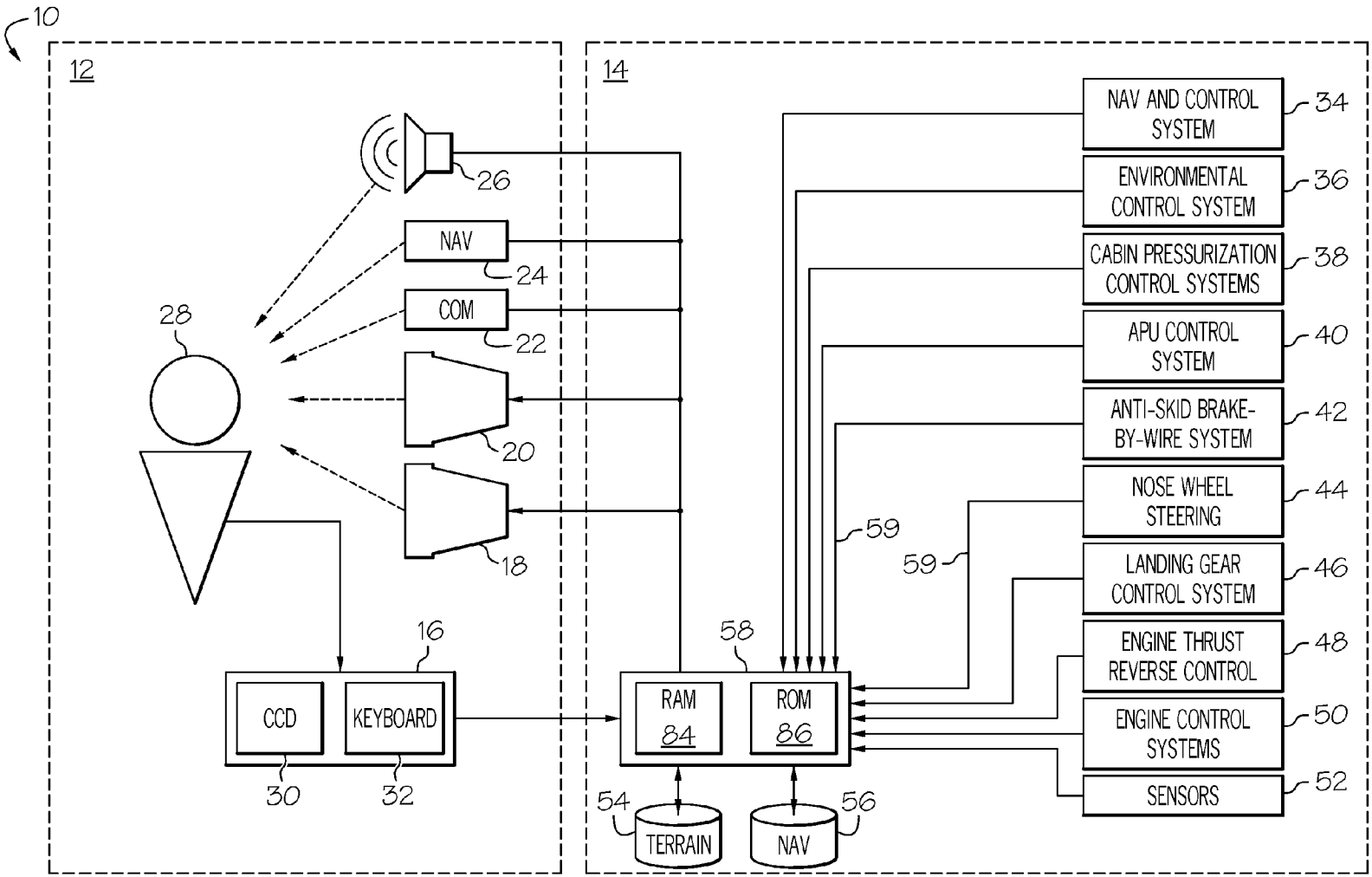
FIG. 1 is a block diagram schematically illustrating an vehicle according to one embodiment of the present invention.
Figure 2:
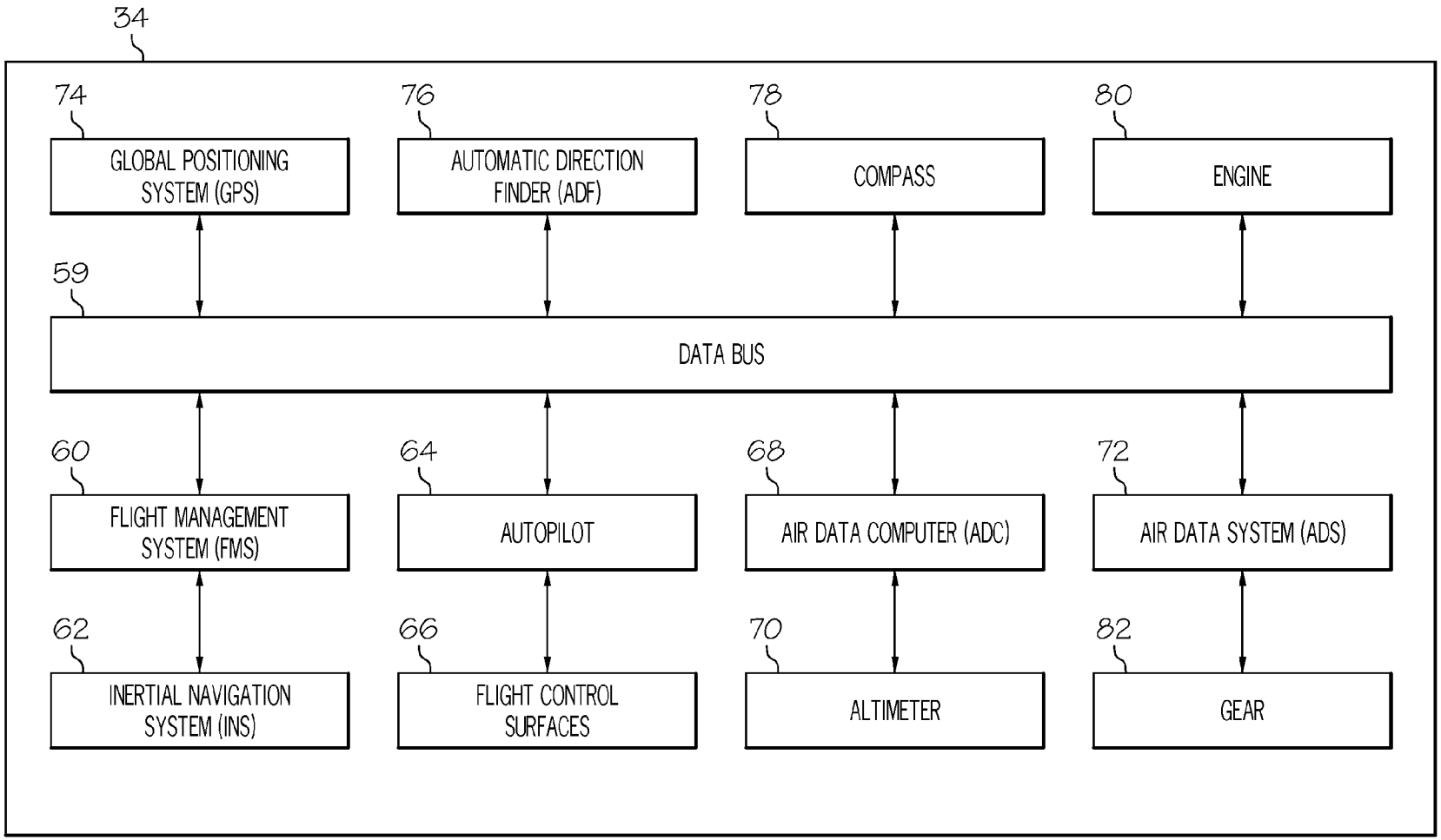
FIG. 2 is a block diagram of a navigation and control system within the vehicle of FIG. 1.
Figure 3:
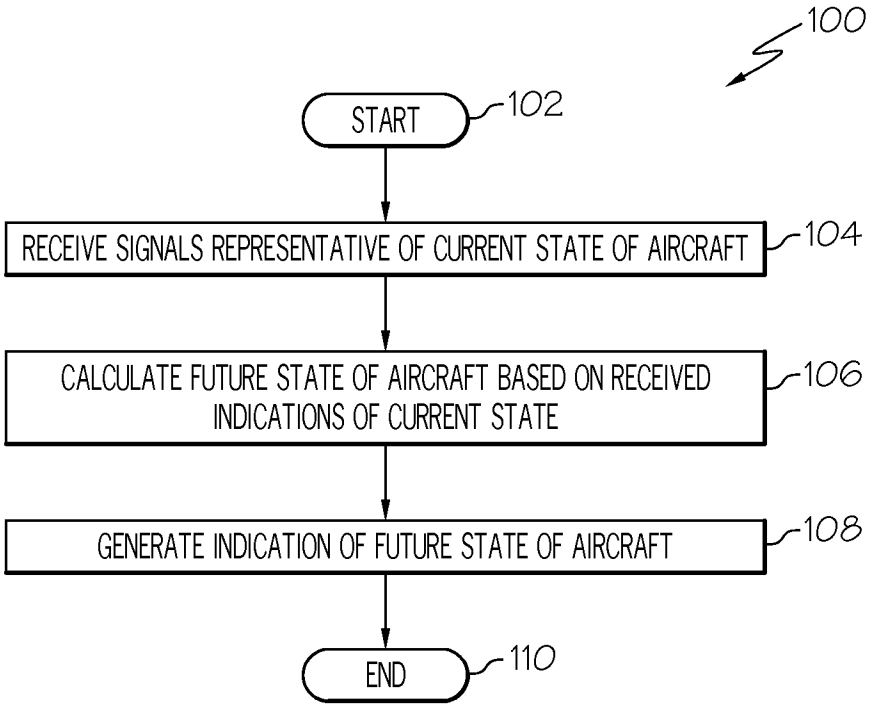
FIG. 3 is a flow chart of a method for predicting performance of an aircraft, according to one embodiment of the present invention.

FIG. 1 to FIG. 3 illustrate methods and systems for operating an avionics system on-board an aircraft so as to predict the performance of the aircraft. A plurality of signals representative of a current state of the aircraft are received. A future state of the aircraft is calculated based on the signals representative of the current state of the aircraft. An indication of the future state of the aircraft is generated with the avionics system on-board the aircraft. In one embodiment, the calculating of the future state of the aircraft is performed on-board the aircraft by the avionics system (and/or a subsystem thereof).

The calculating of the future state of the aircraft may also be based on at least one air performance model associated with the aircraft as a whole and/or one or more components of the aircraft. The signals may be representative of an orientation of the aircraft, a position of the aircraft, an air speed of the aircraft, or a combination thereof.

FIG. 1 schematically illustrates a vehicle 10, such as an aircraft, in which the method and system described below may be implemented, according to one embodiment of the present invention. The vehicle 10 may be, in one embodiment, any one of a number of different types of aircraft such as, for example, a private propeller or jet engine driven airplane, a commercial jet liner, or a helicopter. In the depicted embodiment, the aircraft 10 includes a flight deck 12 (or cockpit) and a flight system 14. Although not specifically illustrated, it should be understood that the aircraft 10 also includes a frame or body to which the flight deck 12 and the flight system 14 are connected, as is commonly understood. It should also be understood that various components on the flight deck and the flight system 14 may jointly form what is referred to as an "avionics" system, as is commonly understood, and may be referred to as "avionics devices."

As shown in FIG. 1, the flight deck 12 includes a user interface 16, display devices 18 and 20 (e.g., a display screen for a flight management system (FMS) and a primary flight display (PFD)), a communications radio 22, a navigational radio 24, and an audio device 26. The user interface 16 is configured to receive manual input from a user 28 and, in response to the user input, supply command signals to the flight system 14. It should be understood that the user 28 may refer to various types of personnel, such as a pilot or crewperson or a technician or other maintenance engineer.

The user interface 16 may be any one, or combination, of various known flight control devices and user interface/text entry devices including, but not limited to, a cursor control device (CCD), such as a mouse, a trackball, or joystick, and/or a keyboard, one or more buttons, switches, or knobs. As such, the user interface 16 may include a text entry device comprising any device suitable to accept alphanumeric character input from user 28 and convert that input to alphanumeric text on the displays 18 and 20. In the depicted embodiment, the user interface 16 includes a CCD 30 and a keyboard 32. The user 28 uses the CCD 30 to, among other things, move a cursor symbol on the display devices 18 and 20, and may use the keyboard 32 to, among other things, input textual data.

Still referring to FIG. 1, the display devices 18 and 20 are used to display various images and data, in graphic, iconic, and/or textual formats, and to supply visual feedback to the user 28 in response to user input commands supplied by the user 28 to the user interface 16. One or more of the displays 18 and 20 may further be a control display unit (CDU), a multifunction control display unit (MCDU), or a graphical display. It will be appreciated that the display devices 18 and 20 may each be implemented using any one of numerous known displays suitable for rendering image and/or text data in a format viewable by the user 28, such as a cathode ray tube (CRT) displays, a LCD (liquid crystal display), a TFT (thin film transistor) displays, or a heads up display (HUD) projection.

The communication radio 22 is used, as is commonly understood, to communicate with entities outside the aircraft 10, such as air-traffic controllers and pilots of other aircraft. The navigational radio 24 is used to receive from outside sources and communicate to the user various types of information regarding the location of the vehicle, such as Global Positioning Satellite (GPS) system and Automatic Direction Finder (ADF) (as described below). The audio device 26 is, in one embodiment, an audio speaker mounted within the flight deck 12.

The flight system 14 includes a navigation and control system (or subsystem) 34, an environmental control system (ECS) 36, a cabin pressurization control system (CPCS) 38, an auxiliary power unit (APU) control system 40, an anti-skid brake-by-wire system 42, a nose wheel steering system 44, a landing gear control system 46, an engine thrust reverse control system 48, various other engine control systems 50, a plurality of sensors 52, one or more terrain databases 54, one or more navigation databases 56, and a processor 58. The various components of the flight system 14 are in operable communication via sensor inputs (e.g., analog sensor inputs) 59 (or a data or avionics bus).

FIG. 2 illustrates the navigation and control system 34 in greater detail. The navigation and control system 34, in the depicted embodiment, includes a flight management system (FMS) 60, an inertial navigation system (INS) 62, an autopilot or automated guidance system 64, multiple flight control surfaces (e.g., ailerons, elevators, and a rudder) 66, an Air Data Computer (ADC) 68, an altimeter 70, an Air Data System (ADS) 72, a Global Positioning System (GPS) module 74, an automatic direction finder (ADF) 76, a compass 78, at least one engine 80, and gear (i.e., landing gear) 82.

Although not shown in detail, the INS 62 includes multiple inertial sensors, such as accelerometers and gyroscopes (e.g., ring laser gyros), that are configured to calculate, and detect changes in, the position, orientation, and velocity of the aircraft 10, as is commonly understood.

Referring again to FIG. 1, as is commonly understood, the ECS 36 and the CPCS 38 may control the air supply and temperature control, as well as the cabin pressurization, for the flight deck 12 (and the passenger compartment) of the aircraft 10. The ECS 36 may also control avionics cooling, smoke detection, and fire suppression systems.

The APU control system 40 manages the operation of an APU (not shown), which provides power to various systems of the aircraft 10 (e.g., other than propulsion). The anti-skid brake-by-wire system 42 controls the wheel brakes (not shown) during, for example, a rejected take off (as described below) and landing so as to prevent the wheels from locking and losing traction on the runway surface and also prevent tire burst. The nose wheel steering system 44 is activated only when the landing gear is extended and the nose oleo (not shown) is compressed (i.e. when the aircraft 10 is on ground), provides directional control during takeoff. The landing gear control system 46 retracts the landing gear after takeoff and extends before approach and landing. In one embodiment, the individual brakes on the right and left main wheels are operated by right and left brake pedals (e.g., part of the user interface 16) respectively on the rudder control and is mainly used to control the direction of the aircraft after landing and is complimented by rudder movement, which is also linked to the nose wheel which castors through a small angle (e.g., 7 degrees) on either side.

The engine thrust reverse control system 48 and other engine control systems 50 manage the operation of the engines during all stages of operation (e.g., take-off, in flight, and during landing). The engine thrust reverse control system 48 controls the thrust either via user input (e.g., by moving the thrust levers/throttles) or automatically. To ensure that the thrust reversers do not operate during flight, the thrust reversers may be enabled only when the aircraft 10 is on ground, as detected through various sensors such as proximity or Weight On Wheels (WOW) switches, thrust lever position (e.g., IDLE), and/or the altimeter.

Although not illustrated, the sensors 52 may include, for example, a barometric pressure sensor, a thermometer, a wind speed sensor, and an angle of attack sensor, as is commonly understood.

The terrain databases 54 include various types of data representative of the terrain over which the aircraft 10 may fly. The navigation (and/or avionics) databases 56 include various types of data required by the system, for example, state of the aircraft data, flight plan data, data related to airways, waypoints and associated procedures (including arrival and approach procedures) navigational aids (Navaid), symbol textures, navigational data, obstructions, font textures, taxi registration, special use airspace, political boundaries, communication frequencies (en route and airports), approach info, and the like.

The processor (or processing system) 58 may be any one of numerous known general-purpose microprocessors or an application specific processor that operates in response to program instructions. In the depicted embodiment, the processor 58 includes on-board random access memory (RAM) 84 and on-board read only memory (ROM) 86. The program instructions that control the processor 58 may be stored in either or both the RAM 84 and the ROM 86 (or another computer-readable medium) and may include instructions for carrying out the processes described below, including the various algorithms and air performance models used. For example, the operating system software may be stored in the ROM 86, whereas various operating mode software routines and various operational parameters may be stored in the RAM 84. It will be appreciated that this is merely exemplary of one scheme for storing operating system software and software routines, and that various other storage schemes may be implemented. It will also be appreciated that the processor 58 may be implemented using various other circuits, not just a programmable processor. For example, digital logic circuits and analog signal processing circuits could also be used.

It should also be noted that the aircraft 10 is merely exemplary and could be implemented without one or more of the depicted components, systems, and data sources. It will additionally be appreciated that the aircraft 10, the flight deck, and/or the flight system 14 could be implemented with one or more additional components, systems, or data sources, some of which are mentioned below.

According to one aspect of the present invention, the avionics system (and/or the processing system 58) is configured to use algorithms and models of the aircraft as a whole, as well as various components of the aircraft (e.g., flight control surfaces) in combination with various indications (e.g., input signals from sensors) of the current state (or current condition) of the aircraft, to predict a future state (or future performance) of the aircraft.

FIG. 3 illustrates a method 100 for operating an avionics system according to one embodiment of the present invention. The method 100 begins at step 102 with the aircraft 10 in operation, either in-flight or on the ground with the avionics system in operation.

At step 104, multiple signals from various avionics devices of the flight system 14 and/or the navigation and control system 34 are received. The signal from each device is representative of a current state or condition (i.e., an N state) of the aircraft 10, or more particularly, each is representative of a particular aspect of the current state of the aircraft 10. Examples of such inputs or signals include the position of the aircraft 10 from the GPS module 74, directional information from the ADF 76 and/or the compass 78, changes in orientation from the INS 62, positions of flight control surfaces 66, an altitude reading from the altimeter 70, the position of the landing gear 82, available power from the engines 80, topographical information from the terrain database 54, and wind speed and barometric pressure from the sensors 52. Other examples include information related to a flight plan of the aircraft 10 (e.g., stored in the FMS 60) and weather data received from a weather information service (e.g., weather data associated with a region through which the aircraft 10 is intended to fly, as dictated by the FMS 60).

At step 106, a future state or the performance (i.e., an N+1 state) of the aircraft 10 is calculated or predicted based on the indications received at step 104. In one embodiment, the calculation is performed (e.g., by the processing system 58) using algorithms and/or "virtual" (or computer) air performance models stored within the avionics system (e.g., within the ROM 86). As will be appreciated by one skilled in the art, such computer models may be used to simulate and predict the behavior and/or performance of the aircraft 10 as a whole and/or particular components of the aircraft 10 and are often provided to purchasers of aircraft and aircraft components by the various manufacturers. These models may be used during operation of the aircraft (e.g., in flight) and be accessible to the pilot (or other user) inside the cockpit. The models may be integrated into a single model, or each may operate individually as a stand-alone model associated with a particular aspect of aircraft operation (e.g., altitude) or a particular component (e.g., the rudder). The air performance models may also account for fatigue from use (i.e., aging). The predicted future state of the aircraft may correspond to a relatively distant situation (e.g., one hour in the future), or an imminent situation (e.g., as little as 2 seconds in the future).

In other embodiments, the calculating of the future state of the aircraft 10 may be performed by a computing system other than the avionics system (and/or the processing system 58). For example, a ground-based system may monitor the various inputs, calculate the future state of the aircraft 10, and transmit the results to the aircraft 10.

At step 108, an indication (i.e., an alert signal) of the predicted future state of the aircraft 10 is generated by the avionics system, or an alert generator, such as one of the displays 18 and 20 or the audio device 26, in such a way as to alert a user (e.g., the pilot 28) on-board the aircraft 10. In one embodiment, a visual indication is displayed on one of the display devices 18 and 20 (e.g., a text message or symbology). In another embodiment, an aural message is generated by the audio device 26 (e.g., a machine-generated voice warning). It should be understood that the indication alerting the user may be generated only if the predicted future state of the aircraft 10 suggests a suboptimal (e.g., fuel efficiency) and/or a possibly hazardous situation. Additionally, the indication generated may provide additional information to the use, such as a suggested course of action.

One example of such a situation is that the avionics system calculates that the current speed of the aircraft 10 may be too low to negotiate an upcoming turn, as dictated by the flight plan stored in the FMS 60. After making such a determination, the avionics system may alert the user with a visual cue on one of the display devices 18 and 20 and/or provide a voice message with the audio device 26 that includes increasing air speed to a particular value. Additionally, if the avionics system determines, while the aircraft 10 is negotiating the turn, the aircraft 10 is banking unsuitably and/or at an inappropriate speed (and/or the aircraft 10 is nearing such a condition) similar alerts may be generated.

Another example is that the avionics system determines that the aircraft 10 is on approach for landing and the current speed of the aircraft 10 is not suitable for landing. After such a determination, the avionics system may provide a voice command that suggests an appropriate air speed for landing. It should be noted that in such a situation the system may be suggesting an air speed for touch down despite the fact that the aircraft 10 may be several miles from the respective runway. That is, the indication provided may be alerting the user to a possibly hazardous situation in the near future.

A further example is that the avionics system determines that the current weather conditions are not safe for flight. In such a situation, the user may be provided with indications (or alerts) suggesting that the aircraft 10 not fly (and/or take off and/or land) in such conditions. One possible situation may be that weather data received by the avionics system indicates the presence of extreme crosswinds at the respective airport (i.e., for take off or landing).

Still referring to FIG. 3, at step 110, the method 100 ends. Although not specifically shown, it should be understood that the method 100 may then return to step 104 such that the method 100 is continuously being performed. That is, the system is constantly updating (i.e., in real-time) the predicted performance of the aircraft 10 as the input signals received from the various components on the aircraft 10.

The system may also provide predictions based on inputs provided by the user, as opposed to the actual, current conditions. When a decision and an appropriate course of action are needed, the input (e.g., the present operational conditions) may be fed to the appropriate models, which generate a response that is indicated to the user. For example, by entering appropriate inputs, may inquire about the safety of attempting a landing in current weather conditions, although the aircraft 10 is currently not on a landing approach. If the response is adverse, the input may be modified, thus preventing a conventional feed back loop where an inappropriate command changes the state of the aircraft 10 and error recovery measures get deployed. Such simulations may be extremely useful for new pilots or experienced pilots in new terrain (e.g., landing on a new runway) or in abnormal whether conditions.

As another example, this feature may also be used to determine the right ground speed during touch down at a particular touch down point. The ideal speed during touch down may be above a stall speed for the aircraft 10 but below a speed which may cause undue stress on the braking system, as well as an excessive amount of fuel to be used during braking. The ideal speed may be dependent on various conditions like the length of particular runway, the size and weight of the aircraft 10, head wind, etc. Taking such factors into account for determining something such as the optimum ground speed at touch down may require an extremely computation-intensive operation, which if done manually, may consume a considerably amount of time.

As alluded to above, in some embodiments, the system is integrated with various other subsystems that provide information not only about the aircraft 10 but the surrounding conditions, terrain, and landmarks (such as airports). For example, the system may receive weather conditions in a region ahead of the aircraft 10 (e.g., from a weather data service or radar). The weather conditions may then be factored in to the predictions made by the system. Such predictions may include providing the user with an indication of how much farther and/or longer the aircraft 10 may be safely flown before being landed.

In one embodiment, response time and changes in output from a component in response to particular inputs may be measured. The same input may be fed into the system for obtaining the ideal values for output and response time from a particular component. By knowing the ideal response time and magnitude of the response of the component (i.e., via the model) and comparing it to the obtained values (i.e., actual), aging and other issues may be identified and characterized. Thus, the wear and effects of aging may be identified long before the values become unacceptable.

It should be noted that the features described herein may be useful in, for example, general aviation (GA), as well as commercial aviation. As an example, in general aviation, aircraft do not always land on designated runways. The features of the system described herein may determine the ideal touch down point in such cases. Further, because general aviation aircraft are often not equipped with sophisticated error recovery systems, such as stall warning and recovery systems, this prediction system may be extremely useful.

It should also be noted that, in some embodiments, the predictions and other calculations described above are performed live, or in real-time, based on the current inputs from the different subsystems and sensors on the aircraft. One possible reason for inaccuracy of any model output may be attributed to small errors which are integrated as time passes to make the output deviate significantly. However, such errors are prevented because the next state is calculated based on the current state inputs of the sensors and subsystems. It should be noted though that in some embodiments it may be possible to utilize a "stand alone" model of the aircraft (and/or component of the aircraft) if the current state of the aircraft (e.g., sensor input) is not available. Other embodiments utilize the system described above on vehicles other than aircraft, such as watercraft and land vehicles. It should also be understood that the system described above may also be used for maintenance (i.e., when on the ground) provided sufficient data is gathered during operation of the aircraft, or other vehicle, while using the air performance models, as the system may be used to alert maintenance personnel that preventive maintenance may be required.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method for operating an avionics system on-board an aircraft comprising:

receiving a plurality of signals representative of a current operating state of the aircraft;

calculating a future operating state of the aircraft based on the plurality of signals representative of the current operating state of the aircraft and on at least one air performance model associated with the aircraft; and generating an indication of the future operating state of the aircraft with the avionics system on-board the aircraft.

2. The method of claim 1, wherein the calculating of the future operating state of the aircraft is performed by the avionics system on-board the aircraft.

3. The method of claim 1, wherein the at least one air performance model is associated with the entire aircraft.

4. The method of claim 1, wherein the at least one air performance model is associated with a component of the aircraft.

5. The method of claim 1, wherein the plurality of signals comprises an orientation of the aircraft.

6. The method of claim 1, wherein the plurality of signals comprises a position of the aircraft.

7. The method of claim 1, wherein the plurality of signals comprises an air speed of the aircraft.

8. The method of claim 1, wherein the indication of the future operating state of the aircraft comprises a visual indication.

9. The method of claim 1 wherein the indication of the future operating state of the aircraft comprises an audio indication.

10. A method for operating an avionics system on-board an aircraft comprising:

receiving a plurality of signals representative of a current operating state of the aircraft;

calculating a future operating state of the aircraft based on the plurality of signals representative of the current operating state of the aircraft and at least one air performance model associated with the aircraft and on at least one air performance model associated with the entire aircraft, a component of the aircraft, or a combination thereof; and generating an indication of the future operating state of the aircraft with the avionics system on-board the aircraft.

11. The method of claim 10, wherein the calculating of the future operating state of the aircraft is not performed by the avionics system on-board the aircraft.

12. The method of claim 10, wherein the plurality of signals comprises an orientation of the aircraft, a position of the aircraft, an air speed of the aircraft, or a combination thereof.

13. The method of claim 12, wherein the indication of the future operating state of the aircraft comprises a visual indication, an audio indication, or a combination thereof.

14. An avionics system comprising:

a plurality of avionics devices, each being configured to generate a signal representative of a current operating state of an aircraft;

an alert generator configured to provide an alert to a user on-board the aircraft; and a processing system in operable communication with the plurality of avionics devices and the alert generator, the processing system being configured to:

calculate a future operating state of the aircraft based on the signals representative of the current operating state of the aircraft and based on at least one air performance model; and cause the alert generator to generate an alert to the user on-board the aircraft based on the calculated future operating state of the aircraft.

15. The avionics system of claim 14, further comprising a memory device in operable communication with the processing system, the memory device having the at least one air performance model associated with the aircraft stored thereon.

16. The avionics system of claim 15, wherein the signals representative of the current operating state of the aircraft comprise an orientation of the aircraft, a position of the aircraft, an air speed of the aircraft, or a combination thereof.

17. The avionics system of claim 16, wherein the alert generator is a display device, a audio device, or a combination thereof.

* * * * *